US005197247A

United States Patent [19]

Elderson

[11] Patent Number: 5,197,247

[45] Date of Patent: Mar. 30, 1993

[54] COMBINATION BEAD/MOLD FOR SUSPENDED CEILINGS AND THE LIKE

[76] Inventor: William L. Elderson, 6675 Crenshaw Dr., Parma Heights, Ohio 44130

[21] Appl. No.: 621,590

[22] Filed: Dec. 3, 1990

Related U.S. Application Data

[63] Continuation-in-part of Ser. No. 280,319, Dec. 6, 1988, abandoned.

[51] Int. Cl.[5] ..... E04B 5/00

[52] U.S. Cl. ..... 52/288

[58] Field of Search ..... 52/288, 242, 732, 716, 52/717.1, 718.1, 466, 468

[56] References Cited

U.S. PATENT DOCUMENTS 3,606,714 11/1969 Arnett ..... 52/288 X
4,587,781 5/1986 Utley et al. ..... 52/288 X
4,625,490 12/1986 Baslow ..... 52/716
4,899,509 2/1990 Power ..... 52/242 X
4,982,540 1/1991 Thompson ..... 52/716 X

*Primary Examiner*—David A. Scherbel
*Assistant Examiner*—Kien Nguyen
*Attorney, Agent, or Firm*—Renner, Otto, Boisselle & Sklar

[57] ABSTRACT

A combination bead/mold piece joins the functions of a drywall "L" bead and a suspended ceiling perimeter mold into a single member by using a symmetrical trim/support, which ordinarily is intended to be viewed from within a room, at the end of a support arm or flange, which ordinarily is intended to be concealed. The bead/mold provides both trim and support functions for a ceiling at junctions with several different types of walls, for example, one wall that extends above the ceiling and a wall partition that does not extend above the ceiling.

4 Claims, 2 Drawing Sheets

COMBINATION BEAD/MOLD FOR SUSPENDED CEILINGS AND THE LIKE

This application is a continuation-in-part of prior application Ser. No. 07/280,319 filed on Dec. 6, 1988, now abandoned.

TECHNICAL FIELD

This invention relates generally to a combination bead/mold device for suspended ceilings and the like and, more particularly, to a device that provides both support and trim functions for suspended ceilings at the junctions of such suspended ceilings with a variety of different wall surfaces.

BACKGROUND

The use of suspended ceilings in buildings is quite common. Typically a suspended ceiling, which is formed of a plurality of ceiling tiles, is suspended using a plurality of L-shape channels, inverted T-shape supports, and various other components. In some instances a ceiling terminates at a building perimeter wall or support wall where the wall generally is taller than the height of the ceiling. Typically the ceiling support components there are right angle channels that are secured to such wall, for example, by nailing into the wall. The inverted T-shape supports typically are suspended from wires that are secured to a concrete slab or some other frame, grate or support structure above.

For convenience, the interior wall partitions of a building, which are used to separate respective rooms, often do not extend above the height of a suspended ceiling. Rather, the suspended ceiling typically extends directly over the top of such partition and a particular ceiling tile may in fact have portions that extend into both of the rooms on respective opposite sides of such partition. Usually the wall portion is formed of studs, for example of wood or metal, with drywall, e.g., plaster, plaster board, etc., attached to the studs and facing into the respective rooms on opposite sides of the partition. Usually the tops of the drywall panels are finished with a drywall "L" bead and the vertical flange of the "L" bead is covered by spackle or plaster compound which is allowed to harden and then is sanded. This finishing technique prevents fraying of the panel tops and provides a clean edge up to which the wall can be painted, covered by wall covering, and so on. The work involved with this finishing technique is rather substantial, is time consuming and is relatively expensive. Moreover, there is an aesthetically undesirable difference between the top finishing of the interior wall partitions and the right angle components used at the perimeter walls.

Various devices have been used in the past to cover a drywall cut edge or a drywall intersection. However, none of the prior art devices have addressed the problem of non-uniform appearance that results from a suspended ceiling, such as an acoustical ceiling, system intersecting different types of wall systems. None of the prior art devices used for the intersection of two walls is directed to the concept of a single item that would replace the trim members of two dissimilar systems for both support and appearance objectives, regardless of which system with which it is used.

BRIEF SUMMARY OF THE INVENTION

The present invention provides a combination bead/-mold device that is able to support a ceiling from a perimeter wall, to provide a trim function for a wall partition, and importantly to provide a uniform aesthetic appearance regardless of which type of ceiling-/wall junction at which the bead/mold invention is used.

The combination bead/mold of the invention joins the functions of a drywall "L" bead and a suspended (e.g., acoustical) ceiling perimeter mold into a single member. Preferably such joining of functions is accomplished by using a symmetrical trim/support portion, which ordinarily is intended to be viewed from within a room, at the end of the combination bead/mold support arm or flange, which ordinarily is intended to be concealed. Therefore, the combination bead/mold of the invention may replace both the conventional drywall "L" bead and the perimeter mold.

According to an aspect of the invention, then, a combined bead/mold for the junctions of suspended ceilings and walls, or the like, includes a mounting arm for mounting to a wall, partition or the like, and a bead/-mold portion proximate an end of the mounting arm and coupled thereto provide both trim and support functions for a ceiling at junctions with different types of walls, for example, one wall that protruded above the ceiling and a different wall that does not extend above the ceiling.

These and other objectives, features and aspects of the invention will become more apparent as the following description proceeds.

To the accomplishment of the foregoing and related ends, the invention, then, comprises the features hereinafter fully described in this specification and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION

Figure 1:
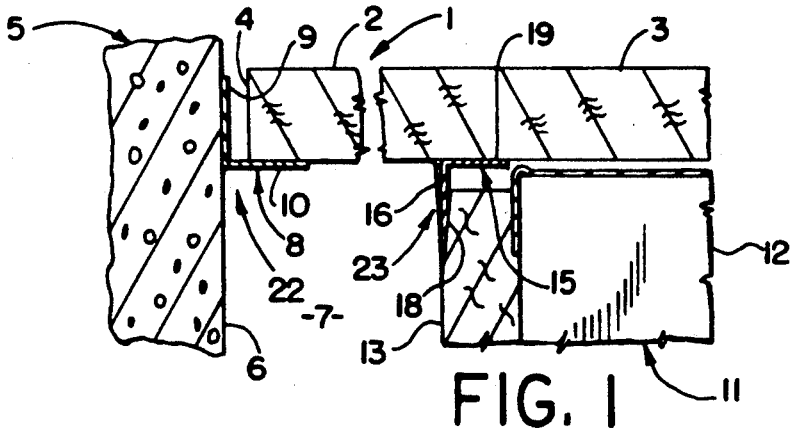
FIG. 1 PRIOR ART
FIG. 1 is a schematic fragmentary section illustration of a prior art conventional suspended ceiling and junctions thereof with a wall that extends above the ceiling and a wall partition that does not extend above the ceiling.

Referring, now, in detail to the drawings, wherein like reference numerals designate like parts in the several figures, and initially referring to FIG. 1, a conventional suspended ceiling 1 includes plural ceiling tiles or panels, 2, 3, each of which is partially shown. The wall-facing edge 4 of ceiling tile 2 faces a wall 5, which extends both above and below the ceiling tile and may be, for example, an exterior wall, a support wall, or some other relatively permanent wall of a building. The wall 5 has a surface 6 that faces into a room 7. The wall 5 may be formed of brick, concrete, wood, or other material and may be finished with drywall, studs and drywall, furring strips and drywall, etc., as is conventional. A trim/support right angle component 8, also known as perimeter mold, has one face or leg 9 engaged with the surface 6 of the wall 5 and preferably is fastened at the leg 9 to the wall 5 usually by nails or screws (not shown). The channel component 8 also has a second face or leg 10 that provides support for the ceiling panel 2 and a trimming function in the event the wall-facing edge 4 of the ceiling panel 2 does not precisely reach the leg 9 and/or the surface 6 of the wall 5, as is well known.

The channel component 8 may be formed by conventional metal forming techniques, such as extrusion, bending, etc. A disadvantage to using such channel component is that it is relatively difficult to hold the same in place relative to the face 6 of the wall 5 while fastening the channel component to the wall.

A wall partition 11 forms another boundary for the room 7. More specifically, the wall partition 11 includes, for example, a stud 12, which may be of wood, metal or other material, and facing material 13. The facing material 13 conventionally is known as drywall, wallboard, plaster board, etc., or may be other material conventionally used in the building industry, for example, paneling. Such material will be referred to hereinafter as drywall for convenience and may be other material, too. As shown, the wall partition 11 does not extend above the ceiling.

The top of the wall partition 11 is finished in conventional manner with a drywall "L" bead 15 and a suitable wall finishing compound 16. The "L" bead 15 has a first leg portion 18 that overlaps the drywall 13 at its upper edge and a second leg 19 that extends over the top edge 18 of drywall. The top edge of drywall 13 and the top edge of stud 12 may no be co-terminal; as is seen in FIG. 1. The open space due to such lack of co-termination is covered by "L" bead 15.

It will be appreciated when viewing the room 7 represented in FIG. 1 that along the junction 22 of the ceiling 1 and wall 5 the horizontally extending leg 10 of perimeter mold 8 is visible. A different appearance occurs at the junction 23 of the ceiling 1 and wall partition 11 where no trim piece is seen. It is undesirable to have such different finish treatments at different respective walls of a room.

Figure 2:
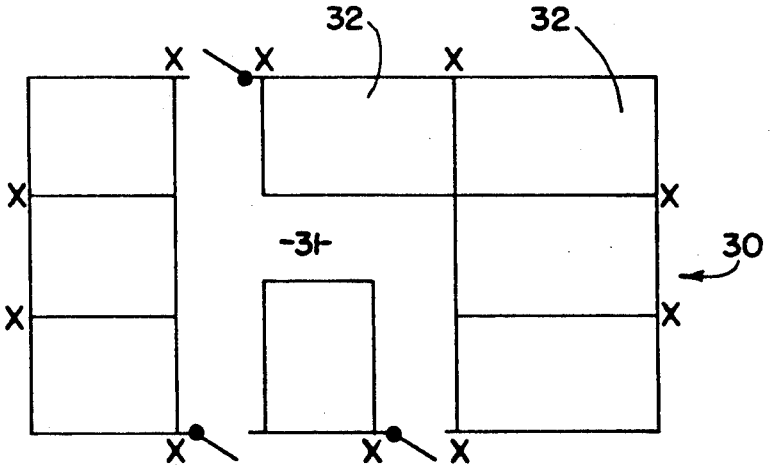
FIG. 2 PRIOR ART
FIG. 2 is a schematic layout of rooms in an exemplary building structure depicting areas where different junctions of the type shown in FIG. 1 would occur.

In FIG. 2 there is illustrated a schematic plan view of several rooms and corridors in a building 30. The corridors are indicated at 31 and various rooms are designated 32, for example. The areas in the building 30 where unmatched transitions between a perimeter mold construction, such as that represented at the junction 22 in FIG. 1 and a wall partition type of junction, such as that represented either at 23 in FIG. 1, for example, are represented by the letter "X" in FIG. 2. The present invention, which is described in greater detail below with respect to FIGS. 3 through 6, provides uniformity of appearance of the junctions and enables a single type of trim piece to be used for a variety of types of construction circumstances and junctions of a suspended ceiling with various walls, as will become apparent from the following detailed description.

Figure 3:
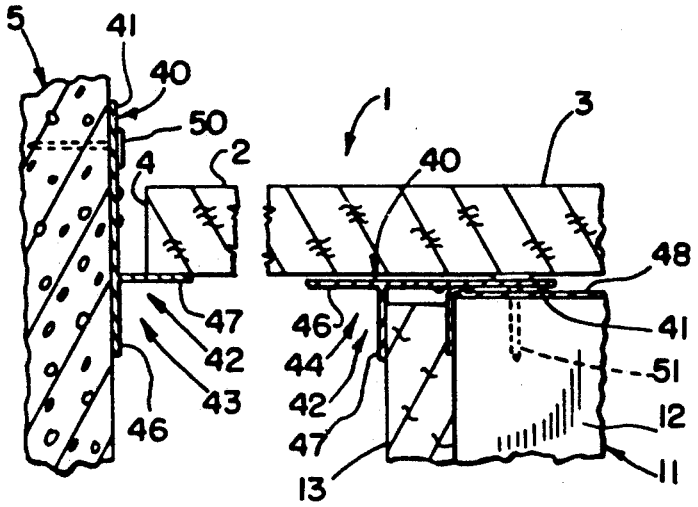
FIG. 3 is a schematic fragmentary section illustration of a combination bead/mold in accordance with the present invention in conjunction with two different types of walls forming respective junctions with a suspended ceiling.
Figure 4:
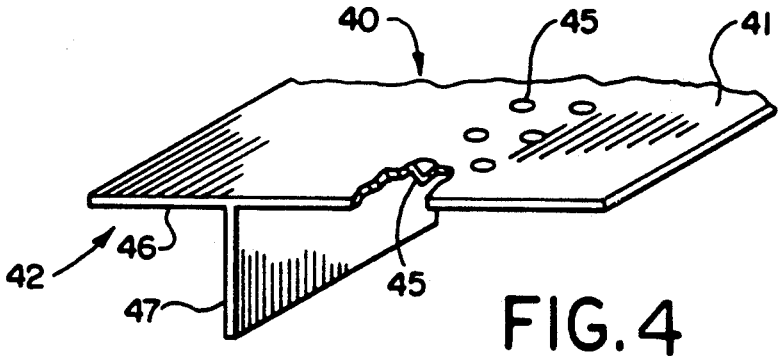
FIG. 4 is a fragmentary isometric view of the combination bead/mold of FIG. 3.

Turning, now, to FIGS. 3 and 4, the preferred embodiment of the invention is illustrated. More specifically, a combination bead/mold 40 includes a mounting arm or mounting flange 41 having a trim/support portion 42 attached thereto. The trim/support portion 42 preferably is located at one end of the mounting arm 41 and is operable to provide functions of supporting ceiling tile and/or trimming the junction of a wall and a ceiling. Exemplary junctions 43, 44 are illustrated in FIG. 3.

The mounting arm 41 preferably is linear, although it may be of other shape to fit the surface into which it is expected to be placed in contact. Ordinarily it is intended that the mounting arm 41 be concealed when the combination bead/mold 40 is in use, i.e., such mounting arm 41 being behind and above the ceiling or between the ceiling and a wall partition stud. Moreover, the mounting arm preferably has a plurality of bump-like detents 45 (e.g., dents in the mounting arm). The detents preferably are arranged in a pair of parallel rows, as is seen in FIGS. 3 and 4. The detents 45 may be used to provide temporary positioning and retention of the combination bead/mold 40 by engaging the raised corner of a wall partition track or channel 48 when the mounting flange 41 is inserted between the partition channel and inverted T-shape supports of the suspended ceiling. While in such position the combination bead/mold 40 may be fastened in place by screws or nails. For drywall applications, one row of detents is provided for ⅝ inch drywall and he other row for ½ inch drywall, although the spacing and number of detents may be varied as desired. Preferably the detents just catch over the raised corner of the partition channel when the trim/support partition 42 is brought to abutment with the wall surface, as shown. Preferably the mounting arm 41 is adequately long to facilitate fastening thereof to a wall 5 or to the wall partition 11 by nails or screws.

As is seen in FIGS. 3 and 4, the trim/support portion 42 of the combination bead/mold 40 has a symmetrical shape. This symmetrical configuration enables the combination bead/mold to be used in both vertical and horizontal orientations, while still presenting uniform, unchanged appearance at the junctions of the wall and ceiling where it is used, regardless of the rotational orientation of the bead/mold 40.

More specifically, the trim/support potion 42 of the combination bead/mold 40 has first and second arms or flanges 46, 47, which extend generally orthogonally to each other thereby to fit at the generally orthogonal intersection of a ceiling and a wall respectively in parallel, preferably engaging, relationship with such ceiling and wall. The angle at which the arms 46, 47 meet may be altered as a function of the particular angular relationship of such wall and ceiling at the junction thereof. However, the right angle or orthogonal relationship is most preferred to enable the combination bead/mold 40 to have greatest versatility regardless of rotational orientation. For the same reason, the first and second arms 46, 47 are oriented such that one is generally parallel and coplanar with the support arm 41 and the other is at a right angle with such support arm.

Figure 7:
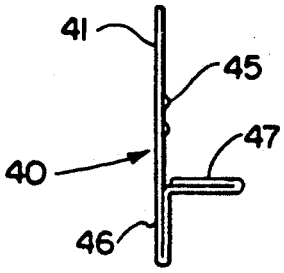
FIG. 7 is a sectional view of the bead/mold as the same may be roll formed from sheet metal.

The combination bead/mold 40 may be formed by conventional metal forming techniques, such as bending metal, by extrusion techniques, roll forming, and so on. The bead/mold may be formed from sheet metal or other material including plastic material. The gage of sheet metal may be the same as that conventionally used to form perimeter bead. If formed from sheet metal one or more of the flanges of the bead/mold may be doubled back on itself as illustrated in FIG. 7 by way of example.

As is seen in FIG. 4, the combination bead/mold 40 may have any convenient length L. The width of the support arm 41 should be adequate to facilitate positioning and fastening as is described herein. The flanges 46, 47 of the trim/support portion 42 preferably are of the same width and shape so as to present the same appearance regardless of how the combination bead/mold 40 is oriented. The flanges 46, 47 may have the same width as the trim/support flange of conventional perimeter mold, such as about ¾ inch to one inch.

In using the combination bead/mold 40, as is seen in FIG. 3, for example, the combination bead/mold may be used at different types of junctions of the ceiling with different respective walls. The junction 43 is one with a perimeter, outside, or support wall-in any event a wall extending above the ceiling. At the junction 43 the combination bead/mold 40 is rotated to a vertical position such that the support arm 41 extends vertically in parallel with the wall 5 and is fastened thereto by a nail 50 driven through the support arm 41. In such vertical orientation the flange 47 supports the ceiling tile 2 and also provides a trim function in the event that the wall facing surface 4 of such ceiling tile does not fully reach the wall 5 and/or support arm 41. Meanwhile, the flange 46 extends downwardly along the wall 5 so that the trim/support portion provides a pair of such flanges 46, 47 which look the same at the junction 43.

At the junction 44 seen in FIG. 3 the combination bead/mold 40 is rotated so as to be oriented horizontally. The junction 44 is of the ceiling 1 and a wall partition 11; the ceiling 1 crosses over the wall partition 11. The support arm extends horizontally in parallel with the top of the wall partition 11 and/or stud 12. The support arm would normally be inserted between the web of channel 48 and the ceiling grid elements (not shown), as by driving the bead/mold with the aid of a hammer, until the vertical flange 47 is butted against the face of the wall. The detents 45 are provided to catch over the raised corner of the channel to hold the support arm against pull out. Then the bead/mold preferably is fastened in place as by nails or screws 51 driven through the support arm 41 and channel 48. In such horizontal orientation the flange 46 provides a trim function. Meanwhile, the flange 47 extends downwardly along the wall partition 11, specifically covering the top edge 18 of drywall 13 to protect the same and, more importantly, to provide a trim function. Thus, in such horizontally rotated orientation, the trim/support portion provides a pair of such flanges 46, 47 which look the same as at the junction 43.

As is illustrated in FIG. 3, it will be seen that at the junction 44 there is no need for an "L" bead, as is seen at 15 in FIG. 1.

The combination bead/mold 40, therefore, is a useful component of a suspended ceiling, such as an acoustical suspension ceiling and suspension system therefor, and it also functions as a wall molding. The combination bead/mold 40 presents the same appearance in both the horizontal and vertical orientation cases even though it is installed with its concealed flanges in opposite orientation. These are preferred features and functions of the combination bead/mold 40 in accordance with the present invention. Due to the foregoing, and in particular, due to the illustrated and described symmetry feature of the combined bead/mold of the invention, the trim/support portion 42 of the combination bead/mold will appear the same regardless of the orientation thereof and, therefore, regardless of the type of wall and type of function at which it is installed.

Figure 5:
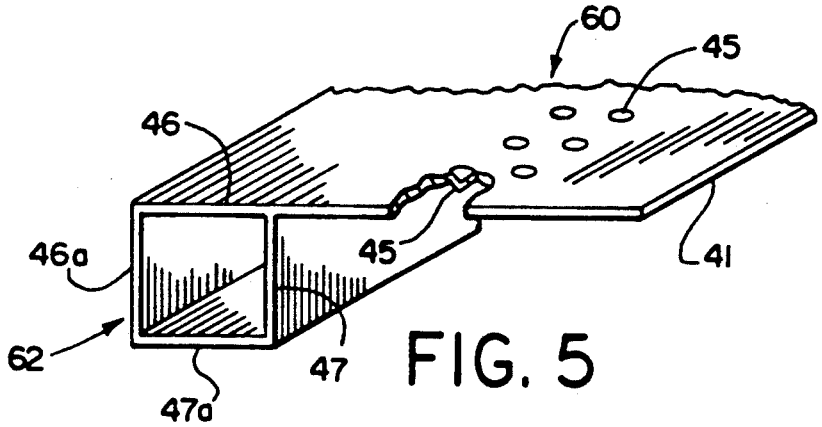
FIG. 5 is a fragmentary isometric view of a modified combination bead/mold.

Briefly referring to FIG. 5, a modified combination bead/mold 60 is illustrated. The modified combination bead/mold 60 is similar in form and function to the combination bead/mold 40 described above. However, in the modified combination bead/mold 60 the trim/support portion 62 is of hollow box-like shape. The box-like shape of the trim/support portion 62 is formed by the flanges 46, 47 and the further flanges **46*a*, 47*a*, as is clearly seen in FIG. 5. Installation, operation and manufacturing of the modified combination bead/mold 60 would be essentially the same as described above for the combination bead/mold 40. However, the combination bead/mold 60 will tend to produce a bead-like or bulk type of appearance at the function of the ceiling and walls where it is placed and used, thus presenting in effect a bead-like or gradual transition between the wall and ceiling. It will be appreciated that this characteristic is accomplished regardless of whether the modified combination bead/mold 60 is used in the above-characterized vertical or horizontal orientations. Such bulk-like appearance would be, for example, similar to that depicted in FIG. 6 where a further modified combination bead/mold 70 is illustrated installed with respect to a wall 5 and a wall partition 11**.

Figure 6:
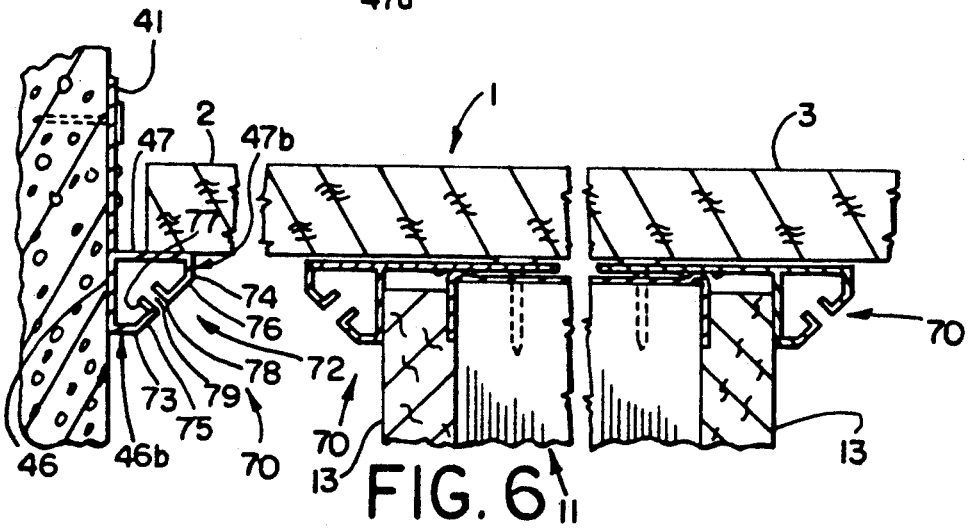
FIG. 6 is a schematic fragmentary section illustration of a further modified combination bead/mold in accordance with the present invention in conjunction with two different types of walls forming respective junctions with a suspended ceiling.

In FIG. 6 the further modified combination bead/mold 70 includes a support arm or flange 41 and a modified trim/support portion 72, which is formed by a pair of flanges 46, 47 and a pair of bent flanges **46*b*, 47*b* that have respective legs 73, 74 that are orthogonal to the flanges 46, 47, angled legs 75, 76, and inwardly bent tab-like legs 77, 78 facing each other at a gap 79. Installation, operation and manufacturing of the further modified combination bead/mold would be essentially the same as that above described for the combination bead/molds 40 and 60. The further modified combination bead/mold 70 will tend to produce a bead-like or bulk type of appearance about the junction of the ceiling and walls where it is placed and used, thus presenting in effect a bead-like or gradual transition between the wall and ceiling. Due to the sloping legs 75, 76, this aesthetic effect is slightly different from the squared effect of the combination bead/mold 60. Moreover, due to the gap 79, which permits some degree of flexing of the flanges 46, 47 relative to each other, the further modified combination bead/mold 70 may have greater tolerance for relative shifting of walls and ceilings in a building during settling, etc. It will be appreciated that these features are accomplished regardless of whether the further modified combination bead/mold 70 is used in the above-characterized vertical or horizontal orientations, both of which are illustrated at respective functions in FIG. 6**.

Figure 8:
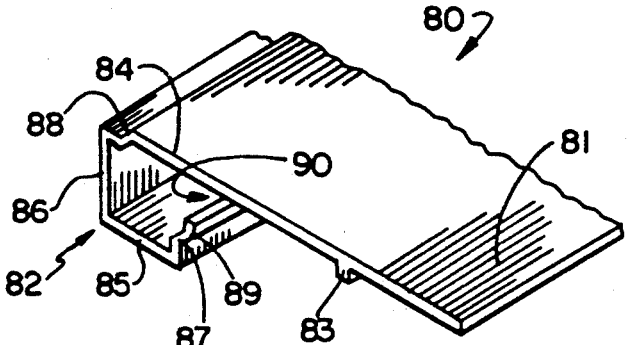
FIG. 8 is an isometric view of a modified combination bead/mold formed through an extrusion process.

In FIG. 8 there is shown a modified bead/mold 80 which has been configured to make it especially adaptable to an extrusion process. The bead/mold 80 includes a support arm 81 and a modified trim/support portion 82. The support arm 81 preferably includes a small linear protrusion 83 running longitudinally with the support arm. The linear protrusion facilitates temporarily securing the bead/mold 80 in place prior to fastening, such as with a screw or nail. When installed, the trim/support portion 82 provides a similar appearance to the box-shape trim/support portion 62 in FIG. 5, however, the box will be somewhat spaced from the intersecting wall and ceiling portions.

The trim/support portion 62 includes opposing flanges 84, 85 and 86, 87, forming the box-shape when viewed from a room in which the bead/mold has been installed. The flanges 84 and 87 are formed with small angled or arcuate sections 88, 89 respectively, which serve to space the flanges 85, 86 from wall and ceiling members from which they perpendicularly extend. The flange 87 is further terminated short of joining the flange 84 and support arm 81 leaving a gap 90. Alternatively, the trim/support portion 82 may be formed such that the flange 87 joins the support arm 81 at a right angle and the flange 84 terminates short of the support arm thus repositioning the gap 90. Regardless, the gap 90 will be blocked from view by an adjacent ceiling or wall member when the bead/mold 80 is installed.

This design of the trim/support portion 82 facilitates forming by an extrusion process and reduces distortions in the trim/support during cooling of the extruded metal. It will be apparent from the foregoing that the trim/support portion, which will not necessarily be structurally symmetric, appears to be symmetric when viewed from a room in which it has been installed regardless of whether the support arm 81 is oriented vertically or horizontally, thus achieving manufacturing simplicity and aesthetic appeal.

INDUSTRIAL APPLICATION

In view of the foregoing description and from the following claims, it will be appreciated that the combination bead/mold invention hereof may be used to provide bead and mold functions at the junctions of a suspended ceiling with a variety of wall systems while still maintaining a uniform aesthetic impression about the entire perimeter of a room in which used.

I claim:

1. A bead/mold used at intersections to trim and support abutting walls, ceilings and the like, comprising:

a mounting arm extending into an area formed between abutting wall and ceiling surfaces and being concealed therein when such bead/mold is installed with respect to a ceiling and a wall;

trim/support means extending from said mounting arm for providing both trim and support functions when said mounting arm is oriented vertically or horizontally, said trim/support means including a pair of symmetrical legs which are oriented at a right angle to each other, each leg being generally parallel with a respective ceiling or wall surface, thereby supporting such ceiling surface and concealing the area of abutment of such abutting wall and ceiling surfaces, said trim/support means presenting a substantially identical visual image with respect to the trim of both abutting surfaces when viewed from the room where such bead/mold is installed when said mounting arm is oriented vertically as it does when said mounting arm is oriented horizontally.

2. A bead mold according to claim 1 wherein one of said symmetrical legs extends orthogonally from one end of said mounting arm such that the other said symmetrical leg extends generally parallel to such mounting arm to provide a bulk-like appearance, said leg that extends orthogonally from said mounting arm also being offset therefrom by an angled extension to space said trim/support means from such intersection.

3. A bead mold according to claim 2 further including a third leg extending from said other leg towards said mounting arm and including an offset portion formed by a second angled extension symmetrical to said first angled extension.

4. A bead mold according to claim 3 wherein said third leg has one end connected to said other leg and another end spaced from said mounting arm.

* * * * *